US009005094B2

(12) United States Patent
Little

(10) Patent No.: US 9,005,094 B2
(45) Date of Patent: Apr. 14, 2015

(54) METHOD OF FORMING A VALVE BAG

(75) Inventor: Richard Little, Whitchurch (GB)

(73) Assignee: Jenton International Limited, Whitchurch, Hampshire (GB)

( * ) Notice: Subject to any disclaimer, the term of this patent is extended or adjusted under 35 U.S.C. 154(b) by 1231 days.

(21) Appl. No.: 12/051,907

(22) Filed: Mar. 20, 2008

(65) Prior Publication Data

US 2008/0232723 A1 Sep. 25, 2008

(30) Foreign Application Priority Data

Mar. 22, 2007 (GB) ..... 0705451.3

(51) Int. Cl.

| | |
|---|---|
| ***B31B 1/84*** | (2006.01) |
| ***B31B 19/84*** | (2006.01) |
| ***B31B 37/00*** | (2006.01) |
| ***B65D 30/24*** | (2006.01) |

(52) U.S. Cl.

CPC ..... *B65D 31/145* (2013.01); *B31B 19/84* (2013.01); *B31B 37/00* (2013.01); *B31B 2219/9058* (2013.01); *B31B 2219/9064* (2013.01); *B31B 2237/20* (2013.01); *B31B 2237/50* (2013.01)

(58) Field of Classification Search

USPC ..... 493/213, 214, 215, 356, 394, 197, 114, 493/87

See application file for complete search history.

(56) References Cited

U.S. PATENT DOCUMENTS

| | | | | | |
|---|---|---|---|---|---|
| 3,130,647 | A | * | 4/1964 | Anderson et al. | 493/193 |
| 3,510,052 | A | * | 5/1970 | Ruda | 383/11 |
| 3,680,768 | A | * | 8/1972 | Warren | 383/40 |
| 4,524,460 | A | * | 6/1985 | Twiehoff et al. | 383/45 |
| 4,744,673 | A | * | 5/1988 | Nakamura | 383/38 |
| 4,844,956 | A | * | 7/1989 | Galimberti | 428/35.5 |
| 4,927,405 | A | * | 5/1990 | Martin et al. | 493/194 |
| 5,080,643 | A | * | 1/1992 | Mitchell et al. | 493/195 |
| 6,068,585 | A | * | 5/2000 | Ouchi | 493/213 |
| 6,890,290 | B2 | | 5/2005 | Pansier et al. | 493/189 |
| 7,036,987 | B2 | * | 5/2006 | Crunkleton et al. | 383/64 |
| 7,185,475 | B2 | * | 3/2007 | Ausnit | 53/412 |
| 7,415,810 | B2 | * | 8/2008 | Plourde et al. | 53/412 |
| 7,553,269 | B2 | * | 6/2009 | DeMatteis et al. | 493/297 |
| 7,597,657 | B2 | * | 10/2009 | Yeager | 493/213 |
| 7,794,380 | B2 | * | 9/2010 | Baker | 493/212 |

FOREIGN PATENT DOCUMENTS

| | | | | |
|---|---|---|---|---|
| EP | 1034918 | A | 9/2000 | |
| EP | 1577223 | | 9/2005 | B65D 33/36 |
| FR | 1292329 | A | 5/1962 | |
| FR | 2425388 | A | 12/1979 | |
| GB | 2351035 | A | 12/2000 | |
| WO | WO 01/12425 | | 2/2001 | B32B 1/84 |

OTHER PUBLICATIONS

European Search Report of EP 08 25 0969.

* cited by examiner

*Primary Examiner* — Sameh H. Tawfik

(74) *Attorney, Agent, or Firm* — Sandra P. Thompson; Slater Hersey

(57) ABSTRACT

A method of forming a valve bag suitable for filling with, for example, powder, grain, cement, animal foodstuffs, via a chute tube inserted into the valve, including forming a combined web from two webs of material, including steps of forming the combined web into a plurality of bag sections, sealing the bag sections at one side such that a valve portion is defined, separating the two webs and moving them outwardly until the bag sections are turned inside, and sealing the two webs to form a valve bag having an strong, effective seal and a valve portion for filling.

4 Claims, 3 Drawing Sheets

METHOD OF FORMING A VALVE BAG

CROSS-REFERENCE TO RELATED APPLICATION

This application is based on and claims priority to United Kingdom Patent Application No. 0705451.3, filed Mar. 22, 2007.

FIELD OF THE INVENTION

This invention relates to valve bags, including a method of producing valve bags.

BACKGROUND OF THE INVENTION

Valve bags, such as for carrying powder, grain, cement, animal foodstuffs, etc., are widely known. A typical valve bag is formed of thick paper having a stitched top and a valve formed in the side of the bag. The valve is opened and impaled onto a chute tube through which material is conveyed into the bag. The bag is effectively self-sealing, as once it has been removed from the chute tube, the valve closes, therefore, preventing the contents of the bag from escaping through the valve.

Disadvantages of the bag described above are the lack of resistance to moisture, such as rain or humidity, and tendency to tear.

Plastic valve bags, and a method and apparatus for making them, are also known. For example, U.S. Pat. No. 6,890,290 (Amplas) discloses a valve bag wherein a film web is formed into a continuous tube, and the tube is sealed internally by a device which is disposed within the tube of material.

The valve bag disclosed in U.S. Pat. No. 6,890,290 is more resistant to moisture and damage such as tearing than a thick paper valve bag. However, the method of forming the bag is complex, and the required equipment is expensive. Therefore, it is only commercially viable to use this method of forming a valve bag for certain applications.

Valve bags are currently used for fairly large quantities of material, and not for small quantities of discrete parts such as nuts, bolts or spare parts. The use of current valve bags for such small quantities is not economical due to the cost of equipment. The use of paper valve bags could also lead to damage of the items by moisture, or the parts themselves could cause damage to a paper valve bag. Therefore, small quantities of discrete parts are usually packaged in bags which must be further sealed after the contents have been put into the bag.

SUMMARY OF THE INVENTION

It is an aim of the present invention to overcome or at least mitigate the above problems.

Accordingly, the present invention provides, in one aspect, a method of forming a valve bag comprising steps of:

unrolling a first web of material and a second web of material, the first and second webs of material both having an upper and a lower side;

creating a combined web by contacting material from the upper side of the first web with material from the lower side of the second web, the combined web being formed of a plurality of bag sections and having a valve side and an opposing open side;

applying a sealing process to the combined web such that the first web is sealed to the second web along part of the valve side, the sealing process defining at least one valve portion in the valve side of each bag section;

separating the first web and the second web at the open side, and folding the first web and the second web outwardly, until a section of the lower side of the first web contacts a section of the upper side of the second web;

sealing together the contacting sections of the lower side of the first web and the upper side of the second web; and separating adjacent bag sections.

Preferably, sealing lines defining the valve extend from a predefined distance from the valve side to the periphery of the valve side.

The invention provides, in a second aspect, a valve bag formed of a first web and a second web, wherein the bag has a valve side having a valve defined by sealing lines, and an opposing side, and wherein at the valve side, an upper side of the first web contacts and a lower side of the second web and is partially sealed thereto, and at the opposing side, the lower side of the first web is sealed to the upper side of the second web.

The present invention provides a much simpler and less expensive method of production than prior art methods. An advantage of the present invention is that conventional machinery can be used, therefore, providing an inexpensive and simple method of manufacture of valve bags. Therefore, various sizes and quantities of valve bag may be produced economically. Small valve bags can be produced, for example, to hold small items such as nuts, bolts or spare parts. Once the small items have been put into the bags, the bags do not need to be further sealed, thus, resulting in a time and cost saving.

A further advantage of the present invention is that various materials can be used to form the bag, thus, allowing choice of material according to required properties.

The web material used in the present invention may be a heat sealable plastic material. An advantage of a heat sealable plastics material is that it is resistant to moisture and less susceptible to damage such as tearing. The thickness of the material may be selected according to the application of the valve bag and therefore the strength required.

One or both of the webs of material may be clear. The use of one clear and one opaque web would provide easy identification of the contents of the bag, and allow for the printing of product details on the opaque web.

BRIEF DESCRIPTION OF THE DRAWINGS

An embodiment of the present invention will now be described by way of example and with reference to the accompanying drawings in which.

DETAILED DESCRIPTION OF THE EMBODIMENTS

Figure 1:
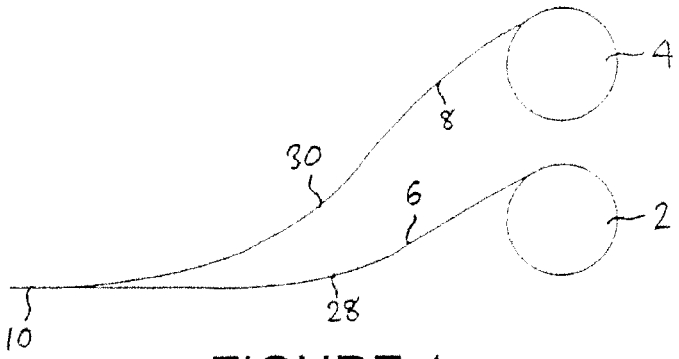
FIG. 1 is an elevation of webs of material used in the first stage of the method of forming a valve bag according to the present invention.

In the present invention, a first web of material 2, such as a heat sealable plastics material, is positioned in registry with to a second web of material 4, as shown in FIG. 1. The first stage of production of the valve bags involves material from the first and second webs being unrolled, and the two webs of material being brought together, such that the upper side 6 of the first web 2 contacts the lower side 8 of the second web 4, to form a combined web 10.

Figure 2:
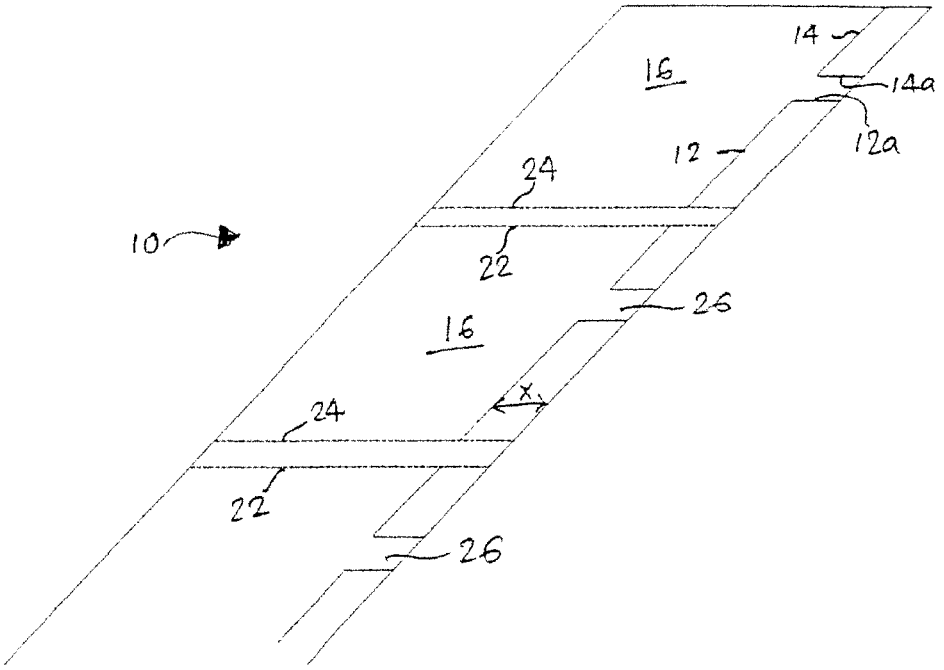
FIG. 2 is a plan view of a partially sealed bag portions produced by the second stage of production of the present invention.

In the second stage of production, as shown in FIG. 2, the combined web 10 is passed through a sealing machine (not shown) to seal the first web 2 and the second web 4 together, along initial lines of sealing 12 and 14. The combined web 10 at this stage can be considered to be formed of a number of bag portions 16, each bag portion 16 being defined by an open side 18, a valve side 20, a top edge 22 and a bottom edge 24. The first and second webs 2, 4 at the open side 18 are separate, i.e., have not been sealed together.

As illustrated in FIG. 2, line of sealing 12 is positioned at a distance X from the valve side 20, and extends from the bottom edge 24 towards the top edge 22, stopping a valve portion 26. Line of sealing 14 is also positioned at a distance X from the valve side 20, and extends from the top edge 22 towards the bottom edge 24, stopping at valve portion 26. Line of sealing 12*a* extends from the end of line of sealing 12 furthest from the bottom edge 24 to the periphery of the valve side 20. Line of sealing 14*a* extends from the end of line of sealing 14 furthest from the top edge 22 to the periphery of the valve side 20. Lines of sealing 12*a* and 14*a*, therefore, define the valve section 26, which is unsealed between lines 12*a* and 14*a*.

Figure 3:
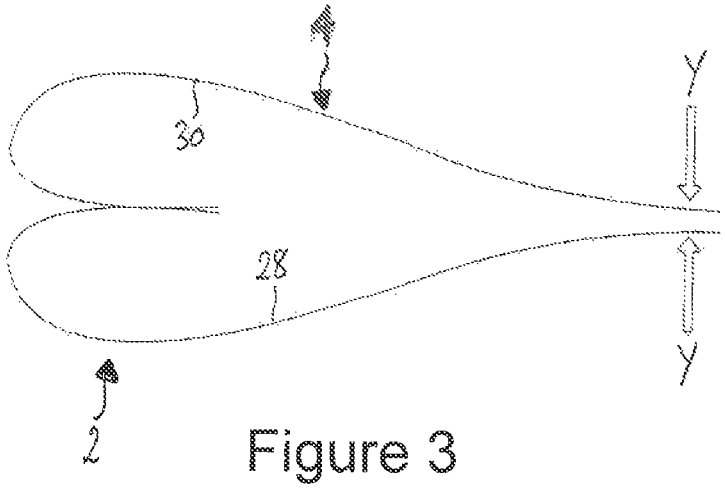
FIG. 3 is a cross-sectional view through a bag portion of FIG. 2 at a third stage of production.

In a third stage of production, as illustrated in FIG. 3, the first and second webs 2, 4 at the open side 18, are separated and folded fully outwardly and brought back together at the other side of the valve side 20. A section of the lower side 28 of the first web 2 is brought into contact with a section of the upper side 30 of the second web 4. Thus, the combined web 10 is effectively turned inside out.

Figure 4:
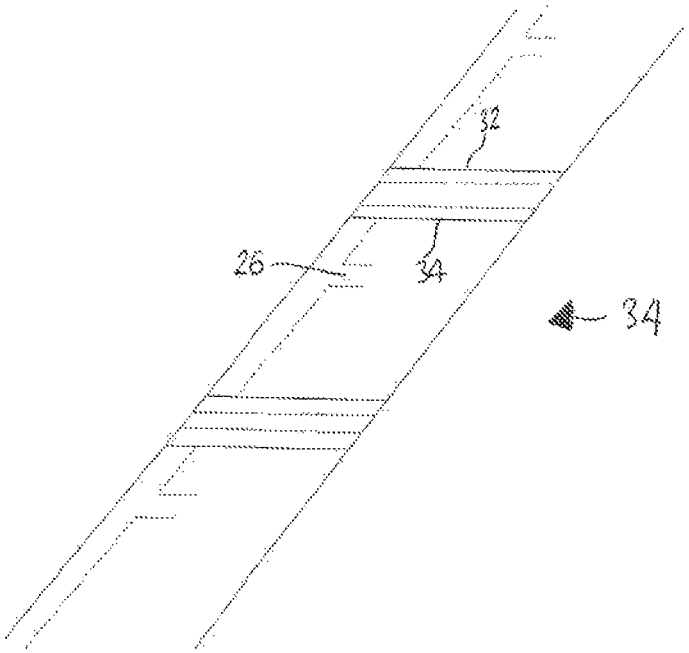
FIG. 4 is an elevation of fully sealed bag portions produced by a method in accordance with the present invention.

The contacting sections of the lower side 28 of the first web 2 and upper side 30 of the second web 4 are then sealed together at Y in the fourth stage of production, effectively forming a tube of material 36 (FIG. 4). In the fifth stage of manufacture, the tube 36 is passed through a bottom welding machine (not shown), which forms sealing lines 32, 34 near the top and bottom edges 22, 24 of the bag sections 16, as illustrated in FIG. 4. The bag sections 16 are then cut between the top edge 22 of one bag section and the bottom edge 24 of an adjacent bag section to form individual valve bags.

Figure 5A:
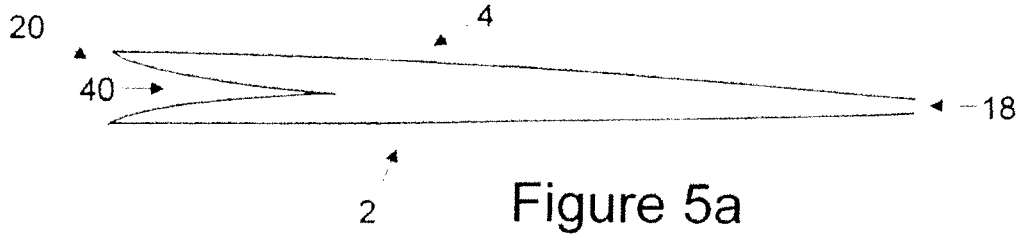
FIGS. 5*a* and 5*b* are cross-sectional views through a bag portion having a gusset formed on the valve side and the open side respectively.
Figure 6:
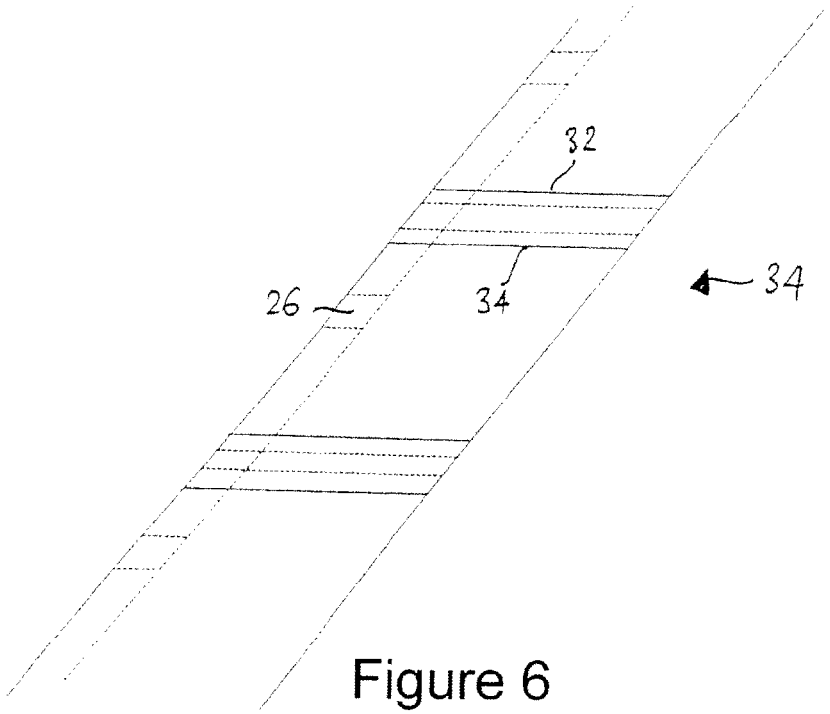
FIG. 6 is an elevation of fully sealed bag portions having a gusset on the valve side.

FIG. 5*a* illustrates a bag portion having a gusset 40 formed in the valve side 20. The forming of the gusset would occur during the third stage of production, with the first and second webs being flattened together before the combined web has been turned fully inside out. FIG. 6 corresponds to FIG. 5*a* and shows fully sealed bag portions having a gusset on the valve side.

Figure 5B:
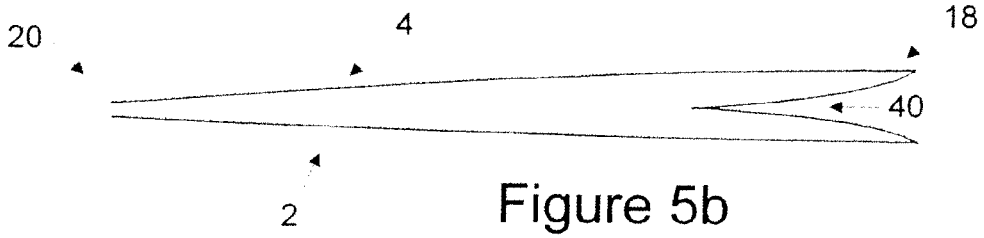

A gusset could also be formed on the open side 18, as illustrated in FIG. 5*b*.

Filling of the valve bags can then be achieved by usual the usual method of inserting a impaling the valve portion 26 of the bag onto a chute tube and flowing the contents through the chute tube into the bag. Once the chute tube is removed from the valve, the valve will be urged closed therefore preventing the escape of the contents of the bag.

What is claimed is:

1. A method for forming a self-sealing valve bag comprising steps of:

unrolling a first web of material and a second web of material, the first and second webs of material both having an upper and a lower side;

creating a combined web by contacting material from the upper side of the first web material from the lower side of the second web, the combined web having a valve side and an opposing open side;

applying sealing lines to the combined web using sealing apparatus located externally to the combined web, such that the first web is sealed to the second web along part of the valve side, the sealing lines defining a valve portion in the valve side;

after the step of applying the sealing lines, separating the first web and the second web at the open side, and folding the first web and the second web outwardly, until a section of the lower side of the first web contacts a section of the upper side of the second web; and sealing together the contacting sections of the lower side of the first web and the upper side of the second web to form three other sides of the bag.

2. A method according to claim 1, wherein the valve portion is defined by sealing lines which extend from a predetermined distance from the said valve side to the periphery of the said valve side.

3. A method according to claim 2, comprising an additional step of forming a gusset on the valve side.

4. A method according to claim 1, comprising an additional step of forming a gusset on the valve side.

* * * * *